US009111478B2

(12) United States Patent
Chu Ke et al.

(10) Patent No.: US 9,111,478 B2
(45) Date of Patent: Aug. 18, 2015

(54) METHOD OF COMPENSATING COLOR GAMUT OF DISPLAY

(71) Applicant: AU Optronics Corp., Hsin-Chu (TW)

(72) Inventors: Hui Chu Ke, Hsin-Chu (TW); Sheng-Wen Cheng, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 208 days.

(21) Appl. No.: 13/783,410

(22) Filed: Mar. 4, 2013

(65) Prior Publication Data

US 2014/0055502 A1 Feb. 27, 2014

(30) Foreign Application Priority Data

Aug. 21, 2012 (TW) ..... 101130237 A

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 2340/06* (2013.01)

(58) Field of Classification Search
CPC ..... G09G 5/02; G09G 5/06; G09G 2340/06; G09G 2360/16; G09G 2320/0276; G09G 2320/0693; H04N 1/6058
See application file for complete search history.

(56) References Cited

U.S. PATENT DOCUMENTS

| | | | | |
|---|---|---|---|---|
| 7,598,961 | B2 * | 10/2009 | Higgins | 345/589 |
| 7,728,846 | B2 * | 6/2010 | Higgins et al. | 345/600 |
| 2007/0097389 | A1 * | 5/2007 | Morovic | 358/1.9 |
| 2007/0139437 | A1 * | 6/2007 | Boroson et al. | 345/590 |
| 2009/0085926 | A1 | 4/2009 | Kim et al. | |
| 2009/0207182 | A1 | 8/2009 | Takada et al. | |
| 2011/0013208 | A1 * | 1/2011 | Bhaskaran et al. | 358/1.9 |
| 2011/0149166 | A1 * | 6/2011 | Botzas et al. | 348/649 |

FOREIGN PATENT DOCUMENTS

CN 101076848 A 11/2007

* cited by examiner

*Primary Examiner* — Jonathan Boyd
*Assistant Examiner* — Sardis Azongha
(74) *Attorney, Agent, or Firm* — Winston Hsu; Scott Margo

(57) ABSTRACT

A method of compensating the color gamut of a display includes establishing a plurality of color gamut boundaries of four color hues, generating m sets of original luminance, chrominance and hue values according to m sets of tricolor grey level values, adjusting the chrominance of n sets of luminance, chrominance and hue values of the m sets of luminance, chrominance and hue values exceeding the plurality of color gamut boundaries with four color hues to generate n sets of corrected luminance, chrominance and hue values, generating m sets of four color grey levels according to the n sets of corrected luminance, chrominance and hue values and (m−n) sets of uncorrected luminance, chrominance and hue values, and displaying images on the display according to the m sets of four color grey levels.

12 Claims, 6 Drawing Sheets

METHOD OF COMPENSATING COLOR GAMUT OF DISPLAY

BACKGROUND

1. Field

The disclosure relates to a method of compensating color gamut of a display, especially a method of transforming the tricolor image values of the display into four color image values to compensate color gamut of the display.

2. Description of the Prior Art

Liquid crystal displays (LCDs) and light emitting diode (LED) displays are widely used nowadays. Because their slim shapes, low power dissipation and low radiation, LCDs and LED displays are widely applied on mobile electronic devices such as notebooks, monitors, and PDAs (personal digital assistants). In general, tricolor (red, green and blue colors) light emitting elements are applied in the related art LCDs and LED displays, to display images with high luminance and chrominance. For display devices, saving power is an important issue. Thus, four color (red, green, blue and white colors) displays capable of raising transmittance and reducing backlight power consumption are developed. The four color display raises luminance through high transmittance of the white color backlight, and saves power by improving light emitting efficiency.

However, when the number of colors of sub-pixels increases from three to four, the layout area of conventional red, green, and blue color sub-pixels will be reduced. Moreover even the brightest red, green and blue colors are darker than white, lowering the effect of light emitted by red, green and blue color sub-pixels. That is, the addition of white color sub-pixels will degrade luminance and chrominance of other color sub-pixels.

SUMMARY

An embodiment of the disclosure relates to a method of compensating color gamut of a display. The method comprises establishing a plurality of color gamut boundaries of four color hues, generating m sets of original luminance, chrominance and hue values according to m sets of tricolor grey level values, adjusting chrominance values of n sets of original LCH values of the m sets of original LCH values exceeding the plurality of color gamut boundaries to generate n sets of calibrated LCH values, generating m sets of four color grey level values according to the n sets of calibrated LCH values and (m−n) sets of original LCH values, and displaying an image on the display according to the m sets of four color grey level values. m and n are positive integers, and m≥n.

Another embodiment of the disclosure relates to a display comprising a plurality of pixels and a signal transformation unit. Each pixel of the plurality of pixels comprises four sub-pixels for displaying an image according to four color image values. The signal transformation unit is used for transforming tricolor image values of the pixels into four color image values of the pixels. Among m pixels of the pixels having color saturation values of tricolor image values between 0.7 and 1, a ratio of Wmax and max{min[R,G,B]} of n pixels having similar color saturation values is not larger than 1. Wmax denotes a largest value of n white color image values of four color image values of the n pixels, and max{min[R,G,B]} denotes a largest value of n smallest tricolor values of the tricolor image values of the n pixels.

Another embodiment of the disclosure relates to a display comprising a plurality of pixels and a signal transformation unit. Each pixel of the plurality of pixels comprises four sub-pixels for displaying an image according to four color image values. The signal transformation unit is used for transforming tricolor image values of the pixels into four color image values of the pixels. Among m pixels of the pixels having color saturation values of tricolor image values between 0.2 and 0.55, a ratio of Wmax and max{min[R,G,B]} of n pixels having similar color saturation values is not smaller than 1, Wmax denotes a largest value of n white color image values of four color image values of the n pixels, and max{min[R,G,B]} denotes a largest value of n smallest tricolor values of the tricolor image values of the n pixels.

Another embodiment of the disclosure relates to a display comprising a plurality of pixels and a signal transformation unit. Each pixel of the plurality of pixels comprises four sub-pixels for displaying an image according to four color image values. The signal transformation unit is used for transforming tricolor image values of the pixels into four color image values of the pixels. Among m pixels of the pixels having color saturation values of tricolor image values between 0.55 and 0.7, a ratio of Wmax and max{min[R,G,B]} of n pixels having similar color saturation values is not equal to 1, Wmax denotes a largest value of n white color image values of four color image values of the n pixels, and max{min[R,G,B]} denotes a largest value of n smallest tricolor values of the tricolor image values of the n pixels.

These and other objectives of the disclosure will no doubt become obvious to those of ordinary skill in the art after reading the following detailed description of the preferred embodiment that is illustrated in the various figures and drawings.

DETAILED DESCRIPTION

Some phrases are referred to specific elements in the present specification and claims, please notice that the manufacturer might use different terms to refer to the same elements. However, the definition between elements is based on their functions instead of their names. Further, in the present specification and claims, the term "comprising" is open type and should not be viewed as the term "consisted of."

The embodiments and figures are provided as follows in order to illustrate the disclosure in detail, but the claimed scope of the disclosure is not limited by the provided embodiments and figures.

Figure 1A:
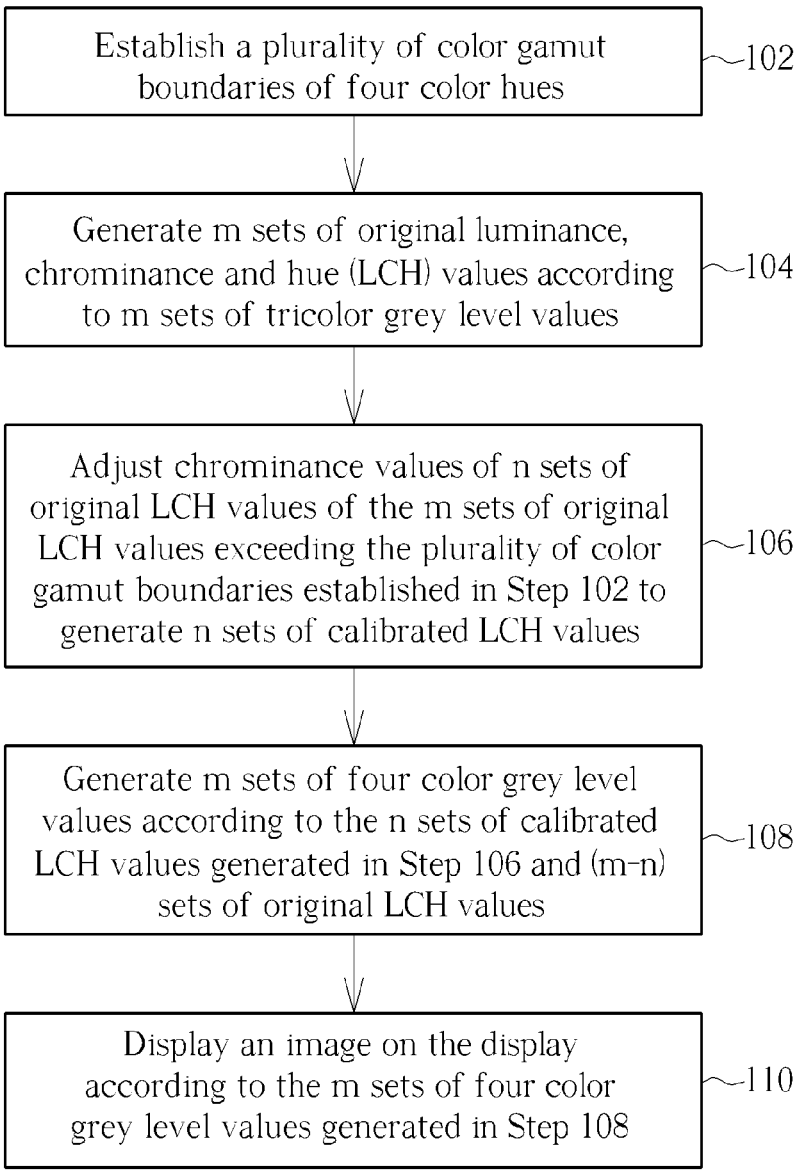
FIG. 1A is a flowchart showing compensating color gamut of a four color display according to a first embodiment of the disclosure.

Please refer to FIG. 1A, which is a flowchart showing compensating color gamut of a four color display according to a first embodiment of the disclosure. The descriptions of the flowchart in FIG. 1A are as follows:

Step 102: establish a plurality of color gamut boundaries of four color hues;

Step 104: generate m sets of original luminance, chrominance and hue (LCH) values according tom sets of tricolor grey level values;

Step 106: adjust chrominance values of n sets of original LCH values of the m sets of original LCH values exceeding the plurality of color gamut boundaries established in Step 102 to generate n sets of calibrated LCH values;

Step 108: generate m sets of four color grey level values according to the n sets of calibrated LCH values generated in Step 106 and (m−n) sets of original LCH values;

Step 110: display an image on the display according to the m sets of four color grey level values generated in Step 108;

In Step 102, the plurality of color gamut boundaries of four color hues can be a plurality of color gamut boundaries of red, green, blue and white color hues or another four colors. In Step 104, tricolor can be red, green, and blue colors. And the m sets of tricolor grey level values are transformed into the m sets of original luminance, chrominance and hue (LCH) values. However in a four color display, after transforming the m sets of tricolor grey level values into the m sets of original LCH values, the chrominance may be distorted, thus Step 106 should be performed. That is, if a set of original LCH values exceeds color gamut boundaries of four color hues, the chrominance value of the set of original LCH values should be adjusted to be on a corresponding color gamut boundary of four color hues, to generate a set of calibrated LCH values. Therefore if n sets of original LCH values among m sets of original LCH values exceed color gamut boundaries of four color hues, the chrominance values of the n sets of original LCH values are adjusted to be on corresponding color gamut boundaries of four color hues, to generate n sets of calibrated LCH values. m and n are positive integers, and After above calibration, in Step 108, the m sets of four color grey level values can be generated according to the n set of calibrated LCH values and the (m−n) sets of original LCH values not exceeding the color gamut boundaries of four color hues. Therefore, the four color display can display images according to them sets of four color grey level values. And the images displayed by the four color display will have correct luminance, chrominance and hue.

Figure 1B:
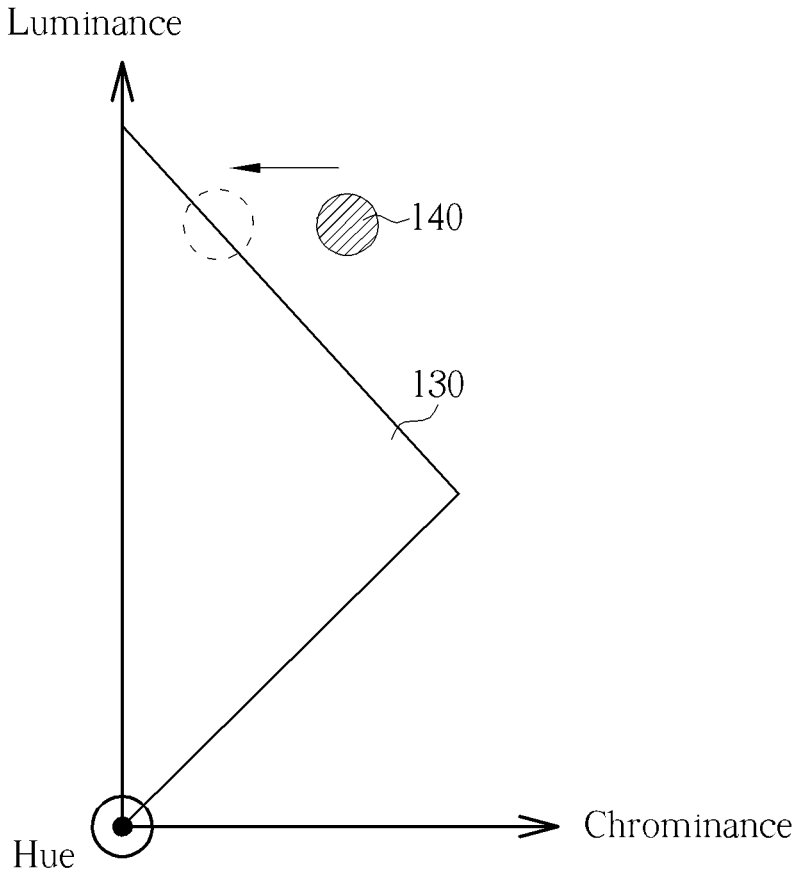
FIG. 1B shows an implementation of adjusting the chrominance value of a set of original LCH values in the step 106 of FIG. 1A.

Please refer to FIG. 1B, which shows an implementation of adjusting the chrominance value of a set of original LCH values in step 106 of FIG. 1A. In FIG. 1B, the horizontal axis represents the chrominance value of a set of original LCH values, the vertical axis represents the luminance value of the set of original LCH values, and the axis perpendicular to the horizontal and vertical axes represents the hue of the original LCH values. The area 130 is within a color gamut boundary of four color hues established in Step 106. When the set of original LCH values 140 is outside of the area 130, the coordinate of the set of original LCH values 140 is adjusted along the horizontal axis to be on the edge of the area 130 as shown by the dotted circle depicted in FIG. 1B to generated a set of calibrated LCH values. Thus, the set of calibrated LCH values 140 no longer exceeds the area 130.

That is, in step 106 of FIG. 1A, the n sets of original LCH values having coordinates outside of the color gamut boundaries of four color hues are calibrated by adjusting their chrominance values without changing their luminance values and hue values.

Figure 2:
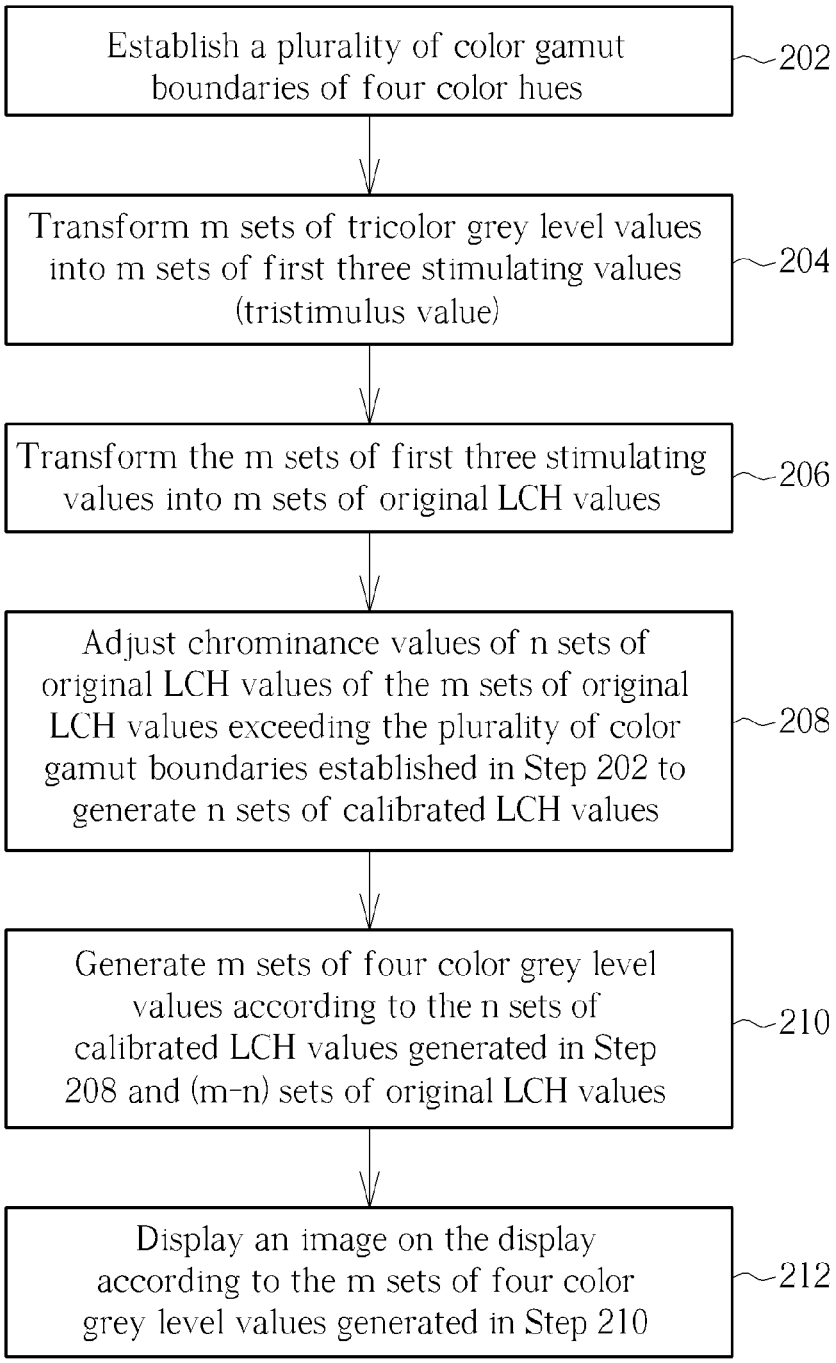
FIG. 2 is a flowchart showing compensating color gamut of a four color display according to a second embodiment of the disclosure.

Please refer to FIG. 2, which is a flowchart showing compensating color gamut of a four color display according to a second embodiment of the disclosure. The descriptions of the flowchart in FIG. 2 are as follows:

Step 202: establish a plurality of color gamut boundaries of four color hues;

Step 204: transform m sets of tricolor grey level values into m sets of first three stimulating values (tristimulus value);

Step 206: transform the m sets of first three stimulating values into m sets of original LCH values;

Step 208: adjust chrominance values of n sets of original LCH values of the m sets of original LCH values exceeding the plurality of color gamut boundaries established in Step 202 to generate n sets of calibrated LCH values;

Step 210: generate m sets of four color grey level values according to the n sets of calibrated LCH values generated in Step 208 and (m−n) sets of original LCH values;

Step 212: display an image on the display according to the m sets of four color grey level values generated in Step 210;

The difference between the first and second embodiments is that, in the second embodiment, the m sets of tricolor grey level values are transformed into the m sets of first three stimulating values, and then the m sets of first three stimulating values are transformed into the m sets of original LCH values. The formulas (1) to (3) are shown below to show how to transform tricolor grey level values into first three stimulating values.

$$X=0.49R+0.31G+0.20B \quad (1)$$

$$Y=0.17697R+0.81240G+0.01063B \quad (2)$$

$$Z=0.00R+0.01G+0.99B \quad (3)$$

In formulas (1) to (3), R denotes a red color grey level value of a set of tricolor grey level values, G denotes a green color grey level value of the set of tricolor grey level values, B denotes a blue color grey level value of the set of tricolor grey level values, X denotes a first value of a set of first three stimulating values corresponding to the set of tricolor grey level values, Y denotes a second value of the set of first three stimulating values, and Z denotes a third value of the set of first three stimulating values.

Since the difference between the first and second embodiments is only on how to transform tricolor grey level values into original LCH values, the images displayed by the four color display in the second embodiment will likewise have correct luminance, chrominance and hue.

Figure 3:
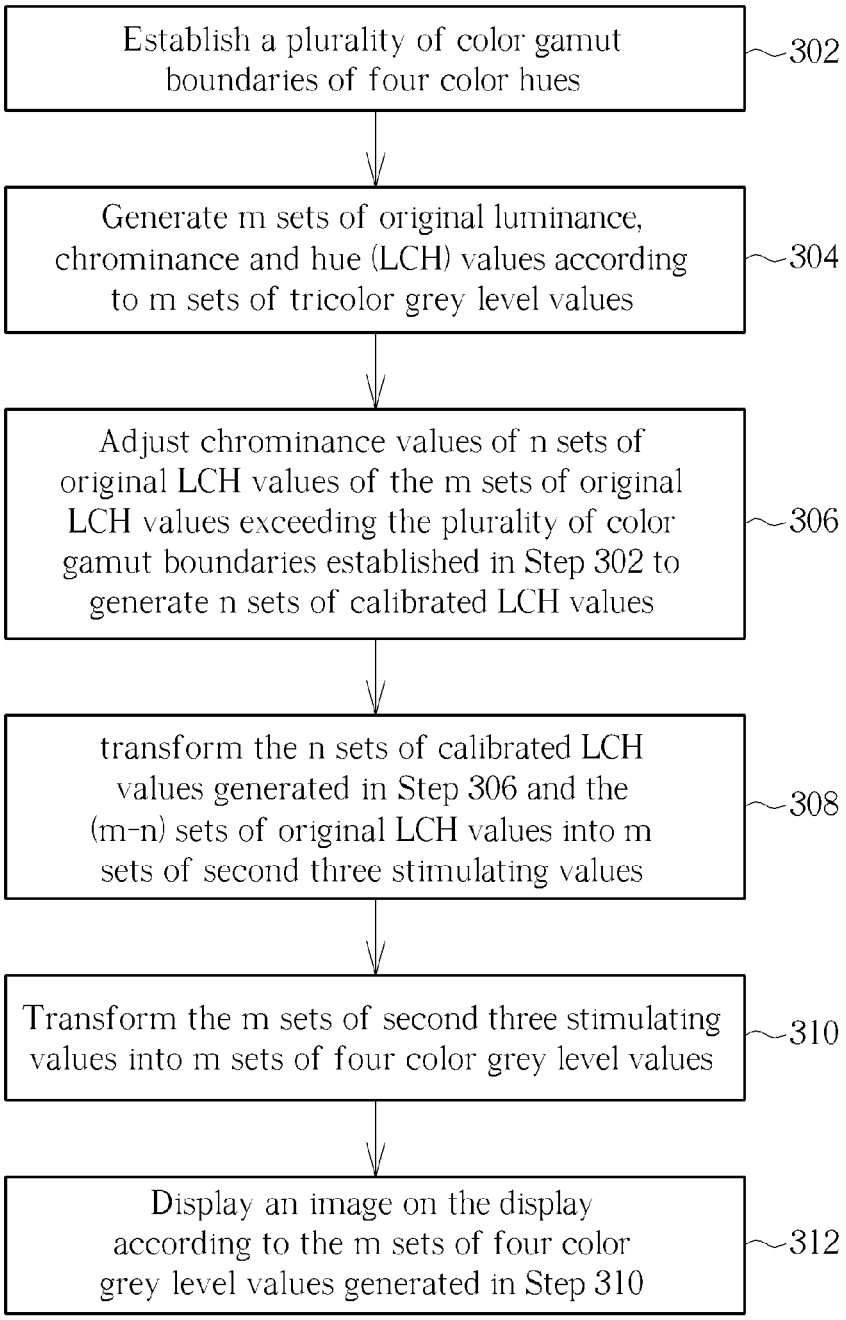
FIG. 3 is a flowchart showing compensating color gamut of a four color display according to a third embodiment of the disclosure.

Please refer to FIG. 3, which is a flowchart showing compensating color gamut of a four color display according to a third embodiment of the disclosure. The descriptions of the flowchart in FIG. 3 are as follows:

Step 302: establish a plurality of color gamut boundaries of four color hues;

Step 304: generate m sets of original luminance, chrominance and hue (LCH) values according tom sets of tricolor grey level values;

Step 306: adjust chrominance values of n sets of original LCH values of the m sets of original LCH values exceeding the plurality of color gamut boundaries established in Step 302 to generate n sets of calibrated LCH values;

Step 308: transform the n sets of calibrated LCH values generated in Step 306 and the (m−n) sets of original LCH values into m sets of second three stimulating values;

Step 310: transform the m sets of second three stimulating values into m sets of four color grey level values;

Step 312: display an image on the display according to the m sets of four color grey level values generated in Step 310;

The difference between the first and third embodiments is that, in the third embodiment, the n sets of calibrated LCH values and the (m−n) sets of original LCH values are transformed into the m sets of second three stimulating values, and then the m sets of second three stimulating values are transformed into the m sets of four color grey level values. The mathematical operations of transforming the second three stimulating values into the m sets of four color grey level values can be obtained by the inverse transformations of formulas (1) to (3), thus will not be further described.

Since the difference between the first and third embodiments is only on how to transform the n sets of calibrated LCH values and the (m−n) sets of original LCH values into the m sets of four color grey level values, the images displayed by the four color display in the third embodiment will likewise have correct luminance, chrominance and hue.

Figure 4:
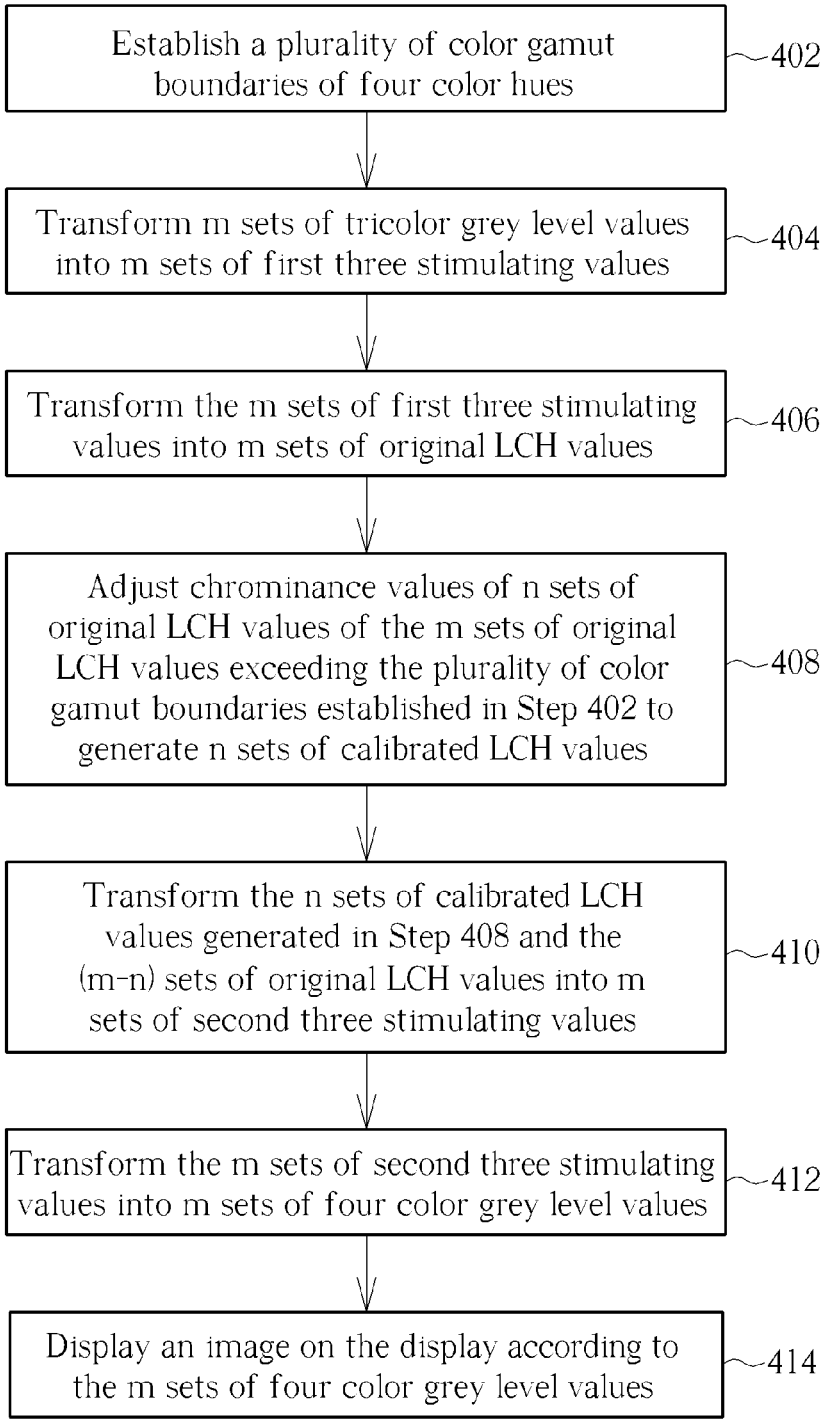
FIG. 4 is a flowchart showing compensating color gamut of a four color display according to a fourth embodiment of the disclosure.

Please refer to FIG. 4, which is a flowchart showing compensating color gamut of a four color display according to a fourth embodiment of the disclosure. The descriptions of the flowchart in FIG. 4 are as follows:

Step 402: establish a plurality of color gamut boundaries of four color hues;

Step 404: transform m sets of tricolor grey level values into m sets of first three stimulating values;

Step 406: transform the m sets of first three stimulating values into m sets of original LCH values;

Step 408: adjust chrominance values of n sets of original LCH values of the m sets of original LCH values exceeding the plurality of color gamut boundaries established in Step 402 to generate n sets of calibrated LCH values;

Step 410: transform the n sets of calibrated LCH values generated in Step 408 and the (m−n) sets of original LCH values into m sets of second three stimulating values;

Step 412: transform the m sets of second three stimulating values into m sets of four color grey level values;

Step 414: display an image on the display according to the m sets of four color grey level values;

The difference between the second and fourth embodiments is that, in the fourth embodiment, the n sets of calibrated LCH values and the (m−n) sets of original LCH values are transformed into the m sets of second three stimulating values, and then the m sets of second three stimulating values are transformed into the m sets of four color grey level values. The mathematical operations of transforming the second three stimulating values into the m sets of four color grey level values can be obtained by the inverse transformations of formulas (1) to (3), thus will not be further described. Since the difference between the second and fourth embodiments is only on how to transform the n sets of calibrated LCH values and the (m−n) sets of original LCH values into the m sets of four color grey level values, the images displayed by the four color display in the fourth embodiment will likewise have correct luminance, chrominance and hue.

Figure 5:
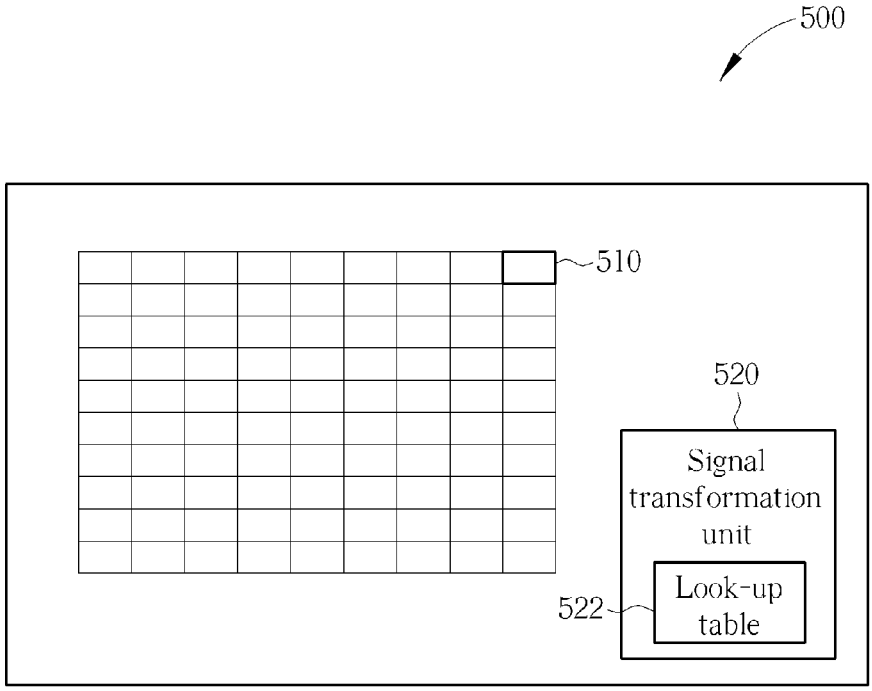
FIG. 5 shows a display according to a fifth embodiment of the disclosure.

Please refer to FIG. 5, which shows a display 500 according to a fifth embodiment of the disclosure. As shown in FIG. 5, the display 500 comprises a plurality of pixels 510 and a signal transformation unit 520. Each pixel 510 comprises four sub-pixels for displaying an image according to four color image values. The signal transformation unit 520 is used for transforming tricolor image values of the pixels into four color image values of the pixels 510. The four colors can be the red, green, blue and white colors, and the tricolor can be the red, green and blue colors as described in the first embodiment. Among m pixels of the pixels 510 having color saturation values of tricolor image values between 0.7 and 1, a ratio of Wmax and max{min[R,G,B]} of n pixels having similar color saturation values is not larger than 1. Wmax denotes a largest value of n white color image values of four color image values of the n pixels, and max{min[R,G,B]} denotes a largest value of n smallest tricolor values of the tricolor image values of the n pixels. R, G and B respectively denote red, green and blue image values in the tricolor image value. The operation expression of the color saturation value is shown in formula (4) below.

$$S = \frac{\max[R, G, B] - \min[R, G, B]}{\max[R, G, B]} \tag{4}$$

In formula (4), max[R,G,B] represents a largest image value of R, G and B, and min[R,G,B] represents a smallest image value of R, G and B. The operations of the aforementioned saturation value S and image values R, G and B can be performed in grey level domain or in gamma domain. That is, the four color image values of the pixels 510 can be four color grey level values or four color gamma values. Similarly, the tricolor image values of the pixel 510 can be tricolor grey level values or tricolor gamma values.

Besides, If the color saturation values of tricolor image values of m pixels of the pixels 510 are between 0.2 and 0.55, a ratio of Wmax and max{min[R,G,B]} of n pixels having similar color saturation values is not smaller than 1. Moreover, If the color saturation values of tricolor image values of m pixels of the pixels 510 are between 0.55 and 0.7, a ratio of Wmax and max{min[R,G,B]} of n pixels having similar color saturation values is not equal to 1.

According to the relationship between the color saturation value S and the ratio of Wmax and max{min[R,G,B]} illustrated in the fifth embodiment, whether the color saturation value S is high (between 0.7 to 1), middle (between 0.55 to 0.7) or low (0.2 to 0.55), the relationship between the color saturation value S and the ratio of Wmax and max{min[R, G, B]} is quite smooth, or substantially linear. Therefore, the gray level overlapping effect of the image can be reduced, reducing color distortion of the display 500.

Further, the signal transformation unit 520 can be configured to comprise a look-up table 522, for mapping the tricolor image values of the pixels 510 to four color image values, and the lookup table 522 can further map the tricolor image values of the pixels 510 to backlight luminance, so as to adjust the backlight of the display 500 accordingly.

In view of above, through utilizing the first to fifth embodiments of the disclosure, the tricolor image values can be transformed into four color image values without distorting the color performance of the four color display. Thus, the four color display can display correct images and save power.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display, comprising: a plurality of pixels, each pixel of the plurality of pixels comprising four sub-pixels for displaying an image according to four color image values; and a signal transformation unit for transforming tricolor image values of the pixels into four color image values of the pixels; wherein among m pixels of the pixels having color saturation values of tricolor image values between 0.7 and 1, a ratio of Wmax and max{min [R, G, B] } of n pixels having similar color saturation values is not larger than 1, to smooth a relationship between the color saturation values of the n pixels and the ratio of Wmax and max{min[R,G,B]} of n pixels and reduce a gray level overlapping effect, where Wmax denotes a largest value of n white color image values of four color image values of the n pixels, and max{min[R,G,B]} denotes a largest value of n smallest tricolor values of the tricolor image values of the n pixels.

2. The display of claim 1, wherein the four color image values of the pixels are four color grey level values of the pixels, and the tricolor image values of the pixels are tricolor grey level values of the pixels.

3. The display of claim 1, wherein the four color image values of the pixels are four color gamma values of the pixels, and the tricolor image values of the pixels are tricolor gamma values of the pixels.

4. The display of claim 1, wherein the signal transformation unit comprises a lookup table for mapping the tricolor image values of the pixels to four color image values of the pixels.

5. A display, comprising: a plurality of pixels, each pixel of the plurality of pixels comprising four sub-pixels for displaying an image according to four color image values; and a signal transformation unit for transforming tricolor image values of the pixels into four color image values of the pixels; wherein among m pixels of the pixels having color saturation values of tricolor image values between 0.2 and 0.55, a ratio of Wmax and max{min [R, G, B] } of n pixels having similar color saturation values is not smaller than 1, to smooth a relationship between the color saturation values of the n pixels and the ratio of Wmax and max{min[R,G,B]} of n pixels and reduce a gray level overlapping effect, where Wmax denotes a largest value of n white color image values of four color image values of the n pixels, and max{min[R,G,B]} denotes a largest value of n smallest tricolor values of the tricolor image values of the n pixels.

6. The display of claim 5, wherein the four color image values of the pixels are four color grey level values of the pixels, and the tricolor image values of the pixels are tricolor grey level values of the pixels.

7. The display of claim 5, wherein the four color image values of the pixels are four color gamma values of the pixels, and the tricolor image values of the pixels are tricolor gamma values of the pixels.

8. The display of claim 5, wherein the signal transformation unit comprises a lookup table for mapping the tricolor image values of the pixels to four color image values of the pixels.

9. A display, comprising: a plurality of pixels, each pixel of the plurality of pixels comprising four sub-pixels for displaying an image according to four color image values; and a signal transformation unit for transforming tricolor image values of the pixels into four color image values of the pixels; wherein among m pixels of the pixels having color saturation values of tricolor image values between 0.55 and 0.7, a ratio of Wmax and max{min [R, G, B] } of n pixels having similar color saturation values is not equal to 1, to smooth a relationship between the color saturation values of the n pixels and the ratio of Wmax and max{min[R,G,B]} of n pixels and reduce a gray level overlapping effect, where Wmax denotes a largest value of n white color image values of four color image values of the n pixels, and max{min[R,G,B]} denotes a largest value of n smallest tricolor values of the tricolor image values of the n pixels.

10. The display of claim 9, wherein the four color image values of the pixels are four color grey level values of the pixels, and the tricolor image values of the pixels are tricolor grey level values of the pixels.

11. The display of claim 9, wherein the four color image values of the pixels are four color gamma values of the pixels, and the tricolor image values of the pixels are tricolor gamma values of the pixels.

12. The display of claim 9, wherein the signal transformation unit comprises a lookup table for mapping the tricolor image values of the pixels to four color image values of the pixels.

* * * * *